US007713138B2

(12) United States Patent
Sato et al.

(10) Patent No.: US 7,713,138 B2
(45) Date of Patent: May 11, 2010

(54) WOOD CLUB

(76) Inventors: Tomohiko Sato, 1322, Hayashima, Hayashima-sho, Tukubo-gun, Okayama (JP) 7010304; Sunao Umemura, 16-16, Takaoka, 7- Chome, Okubo-cho, Akashi-shi Hyogo (JP) 6740057; Yutaka Kawata, 1307-4, Junna, Ikawatani-sho, Nishi-ku, Kobe-shi, Hyogo (JP) 6512124; Mitsuhiro Saso, 291-11, Iida, 2-chome, Himeji-shi, Hyogo (JP) 6700974

( * ) Notice: Subject to any disclaimer, the term of this patent is extended or adjusted under 35 U.S.C. 154(b) by 0 days.

(21) Appl. No.: 12/214,380

(22) Filed: Jun. 18, 2008

(65) Prior Publication Data

US 2009/0264219 A1 Oct. 22, 2009

(30) Foreign Application Priority Data

Apr. 21, 2008 (JP) ..... 2008-110647

(51) Int. Cl.
*A63B 53/04* (2006.01)

(52) U.S. Cl. ..... 473/327; 473/328; 473/345

(58) Field of Classification Search ..... 473/324–350; D21/752, 759
See application file for complete search history.

(56) References Cited

U.S. PATENT DOCUMENTS 1,541,126 A * 6/1925 Dunn ..... 473/328
1,916,792 A * 7/1933 Hadden ..... 473/324
3,068,011 A * 12/1962 Sano ..... 473/328
3,166,320 A * 1/1965 Onions ..... 473/314
3,976,299 A * 8/1976 Lawrence et al. ..... 473/327
4,065,133 A * 12/1977 Gordos ..... 473/327
4,444,392 A * 4/1984 Duclos ..... 473/290
D275,412 S * 9/1984 Simmons ..... D21/175
5,203,565 A * 4/1993 Murray et al. ..... 473/242
5,435,558 A * 7/1995 Iriarte ..... 473/327
5,467,989 A * 11/1995 Good et al. ..... 473/305
5,980,394 A * 11/1999 Domas ..... 473/327

(Continued)

FOREIGN PATENT DOCUMENTS

JP 02-274271 A 11/1990
JP 06-098954 A 4/1994
JP 2001-212267 A 8/2001
JP 2002-291947 A 10/2002

*Primary Examiner*—Sebastiano Passaniti
(74) *Attorney, Agent, or Firm*—Ryndak & Suri LLP

(57) ABSTRACT

A wood type club is provided. A toe-side part and a heel-side part located between the crown part and the sole part of the head are provided with at least one concave groove opened outward in a horizontal direction and extending from the face part to the back part in a longitudinal direction to guide an air stream to the head in a swing action; and a whole or part of the concave groove has a curved part bulging outwardly so that an angle in which a concave groove bottom formed from an inlet of the concave groove to an inside thereof is inclined inward with respect to a line perpendicular to the face part is smaller than an angle in which a line connecting an inlet of the concave groove bottom and an outlet thereof is inclined inward with respect to the line perpendicular to the face part.

4 Claims, 7 Drawing Sheets

U.S. PATENT DOCUMENTS

D421,472 S * 3/2000 Peterson ..... D21/759
6,482,106 B2 * 11/2002 Saso ..... 473/327
6,890,267 B2 * 5/2005 Mahaffey et al. ..... 473/256
D509,869 S * 9/2005 Mahaffey ..... D21/752
7,568,985 B2 * 8/2009 Beach et al. ..... 473/336
2004/0138002 A1 * 7/2004 Murray ..... 473/327

* cited by examiner

WOOD CLUB

TECHNICAL FIELD

The present invention relates to a wood type club, and more particularly, to a wood type club of which a club head is capable of being swung lightly and which is capable of reducing and restricting a covering phenomenon or a toe-down phenomenon of the club head.

BACKGROUND ART

Upon making a score in a golf game, a flying distance and a stable directivity of a hit golf ball are regarded as important components. The flying distance of the golf ball is determined by a head speed and momentum efficiently transmitted from a club head to the golf ball at the moment of hitting the golf ball. Additionally, the stable directivity of the hit ball is determined by whether a face part of the club head faces a line direction of a desired play by restricting a covering phenomenon (a phenomenon that a toe-side part advances more than a heel-side part) of the club head at the moment of hitting the golf ball and the club head takes a square posture against the golf ball by restricting a toe-down phenomenon of the club head.

In the past, Japanese Patent Application Laid-Open No. H06-98954 discloses a club head which reduces and restricts a toe-down phenomenon or a covering phenomenon in such a manner that the center of gravity of the head is moved to a heel side and an outline shape of a back part (a back surface of the head) of the club head is formed so that a curvature (curve state) of a heel-side part is larger than that of a toe-side part.

Recently, a study has been proposed in which a shape of the head is designed from viewpoint of fluid mechanics. For example, Japanese Patent Application Laid-Open No. 2002-291947 discloses a club head which improves posture stability in such a manner that a groove is formed in a back part of the club head so that a vortex flow produced in a head surface is hardly separated from the head surface and a vertical and horizontal deviation of the club head is reduced and restricted during a swing action.

Japanese Patent Publication No. H07-4438 discloses a club head which prevents a laminar separation of a laminar boundary layer flowing along a crown part and a sole part and reduces air resistance in such a manner that an upper-lower-end outline of a face part is formed into a curve surface having a curvature radius of 10 mm or less and a small unevenness is formed in the curve surface.

U.S. Pat. No. 5,980,394 discloses a club head which realizes a stable head posture during a swing action in such a manner that a vortex flow producing part having a concave shape is formed in a crown part, a toe-side part, and a sole part.

Japanese Patent Application Laid-Open No. 2001-212267 discloses a club head which maintains and corrects a head posture to be appropriate in such a manner that a toe-side part and a heel-side part are provided with a concave groove opened outward and extending in a longitudinal direction and a high-speed air stream is caught by the concave groove during a downswing action.

DISCLOSURE OF THE INVENTION

The present inventors have carried out a study about performances of various club heads. As a result of the study, a drag coefficient of a normal club head (a club head having a shape similar to that of a persimmon head) abruptly changes to 1.9, 1.1, and 0.8. On the contrary, in the club head disclosed in Japanese Patent Application Laid-Open No. 2001-212267, a drag coefficient before impact is stable in a range of 0.5 to 0.4 during a downswing action, thereby realizing a very light swing action. Further, since the toe-down phenomenon or the covering phenomenon is reduced and restricted, it is possible to take an ideal posture at the moment of impact. Accordingly, it is proved that the club head is excellent in fluid mechanics.

Incidentally, in case of an actual swing action of the golf club, since the club head substantially moves along a circular-arc orbit around a player's body, it is proved that a vortex flow is produced in the concave groove having a linear shape in the club head disclosed in Japanese Patent Application Laid-Open No. 2001-212267. Since the drag coefficient is further reduced when the vortex flow is reduced, it is possible to further improve the head speed.

The present invention is made in consideration of the above-described problems, and an object of the invention is to provide a wood type club of which a club head is capable of being swung lightly and which is capable of improving a head speed by reducing and restricting a covering phenomenon or a toe-down phenomenon of the club head.

According to an aspect of the invention, there is provided a wood type club which includes a hollow head provided with a face part, a crown part, a sole part, and a back part and in which a hosel is located on a heel side of the crown part so as to be connected to a shaft, wherein a toe-side part (15) and a heel-side part (16) located between the crown part (12) and the sole part (13) of the head (10) are respectively provided with at least one concave groove (20, 21) opened outward in a horizontal direction and extending from the face part (11) to the back part (14) in a longitudinal direction so as to guide an air stream to the head (10) in case of a swing action, and wherein a whole part or a part of the concave groove (20, 21) is provided with a curved part bulging outwardly so that an angle ($\theta 2$) in which a concave groove bottom formed from an inlet of the concave groove (20, 21) to an inside thereof is inclined inward with respect to a line (L) perpendicular to the face part (11) is smaller than an angle ($\theta 1$) in which a line (L1) connecting an inlet of the concave groove bottom and an outlet thereof is inclined inward with respect to the line (L) perpendicular to the face part.

Additionally, the toe-side part and the heel-side part of the head are provided with the concave groove opened outward. An opening width of the concave groove is larger than a depth thereof. A whole part or a part of the concave groove is provided with a curved part bulging outwardly in a circular-arc shape.

Accordingly, when the head moves along a circular-arc orbit around a player during a downswing action, an air stream flows into the concave groove, but since a whole part or a part of the concave groove is curved in a circular-arc shape, the air stream smoothly flows along the concave groove without hardly producing a vortex flow. As a result, it is possible to carry out the very light swing action and thus to improve the head speed.

Further, since the drag coefficient is small and a disorder of an air stream in the circumference of the head is small, it is possible to reduce and restrict the toe-down phenomenon or the covering phenomenon and thus to take a substantially ideal posture at the moment of impact. As a result, it is possible to improve the flying distance and the stable directivity of the hit ball.

Much air contacts with the heel-side part since the heel-side part advances more than the toe-side part of the head during the downswing action. For this reason, the concave groove provided on the heel side and opened outward exhibits an important function. On the other hand, in order to realize a dynamic balance of the club head and a light follow-through action by reducing and restricting the vortex flow during the follow-through action after impact, the concave groove provided on the toe side and opened outward also exhibits an important function.

A vertical opening width of the concave groove is ¼ to ⅖ of a height of the crown part in a vertical sectional view upon taking a normal address posture with the head. In a range less than ¼, since the concave groove opened outward is too narrow, a sufficient amount of air stream cannot flow thereinto. In a range larger than ⅖, the air stream is difficult to be controlled, which is the same as a case in which the air stream just flows a portion on the side of the club head.

For example, in a case where a maximum height of the crown part of the driver is 60 mm, a vertical opening width of the concave groove in a vertical sectional view is desirably in a range of 15 mm to 25 mm.

The sectional shape of the concave groove facing outward may have a shape in which an air stream smoothly flows backward. Specifically, the concave groove may adopt a U-shape, a semi-circular shape, an oval shape, or the like.

The shape of the club head is not particularly limited. The club head having the known persimmon shape is advantageous, but the club head having the substantially square shape proposed by the present inventors has proven to have very excellent performance in fluid mechanics.

That is, the present invention is very effective in fluid mechanics by adopting a configuration in which the back part is formed into an inclined surface inclined toward the face part while being closer to the crown part, and a rear-end outline of the crown part is formed in a linear shape in a head projection plane and protrudes backward in a roof shape so as to be continuously formed with an upper end of the inclined surface of the back part.

The back part may be formed into a flat inclined surface, but may be formed into a circular-arc concave shape or an oval concave shape in which a center portion is lower than both side portions in a toe-heel direction when viewed from the face part.

The crown part is formed in a circular-arc shape in which a line, extending backward while forming an angle in a range of −15° to +15° with respect to a horizontal plane and passing through a position of an upper-end outline of the face part of the head in a reference vertical plane passing through the center of gravity of a head and the center of gravity of a face of the face part of the head upon taking a normal address posture with the head, intersects a position between a rearmost point of the crown part and 25% of a longitudinal distance from the rearmost point to the face part and a maximum vertical distance between the crown part and the line is 10 mm or less. The circular-arc shape of the crown part is a shape of a curve surface continuously formed in a toe-heel direction so as to have a band shape having a predetermined width, for example, 40 mm when viewed from the reference vertical plane.

In this case, it is desirable that an outer surface facing backward from the front end of the crown part has a portion forming an angle (θ4) with respect to the line (L3) of the outer surface in the reference vertical plane, the angle (θ4) being larger than the angle (θ3) formed between the line (L3) and the horizontal plane.

Additionally, when the crown part having the circular-arc shape is formed in a shape of the curve surface continuously formed in a toe-heel direction so as to correspond to the shape of the upper-end outline of the face part, a separation of the air stream is little and the air stream smoothly flows along the outer surface of the crown part without producing a vortex flow.

The crown part is formed in the circular-arc shape in which the line extends backward while forming an angle in a range of −15° to +15° (desirably, in a range of −10° to +10°) with respect to the horizontal plane and the maximum vertical distance between the crown part and the line is 10 mm or less (desirably, 8 mm or less).

Figure 1:
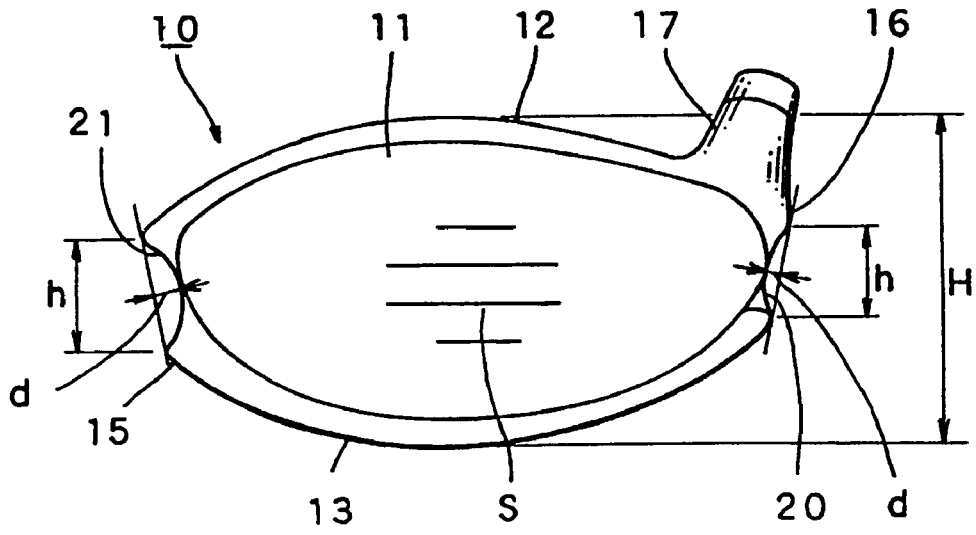
FIG. 1 is a front view illustrating a wood type club according to an embodiment of the invention.
Figure 2:
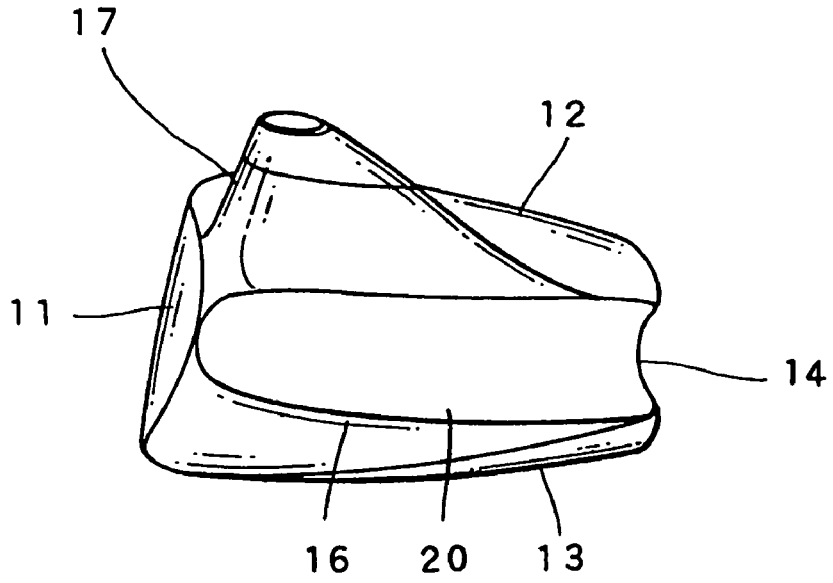
FIG. 2 is a right side view illustrating the wood type club according to the embodiment.
Figure 3:
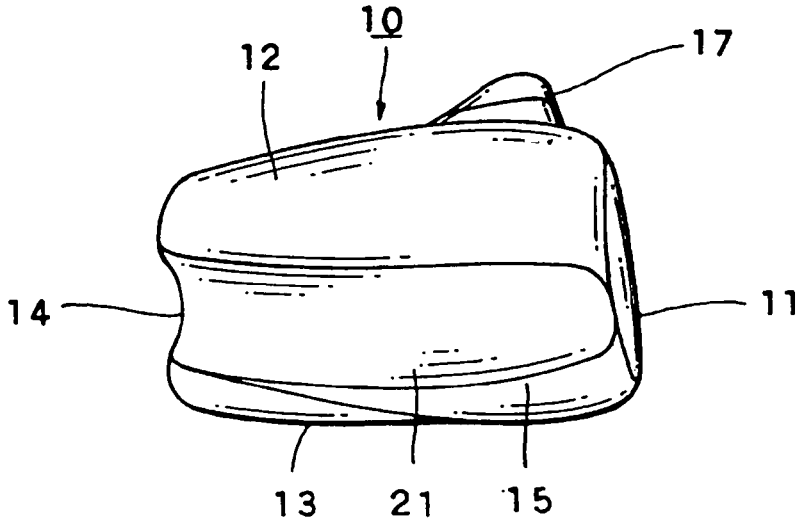
FIG. 3 is a left side view illustrating the wood type club according to the embodiment.
Figure 4:
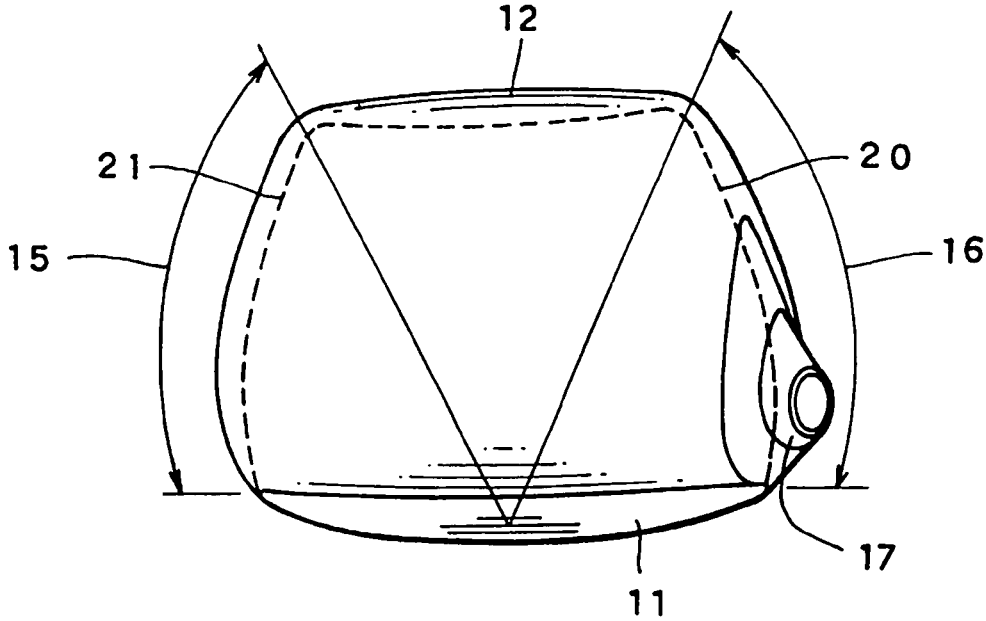
FIG. 4 is a top view illustrating the wood type club according to the embodiment.
Figure 5:
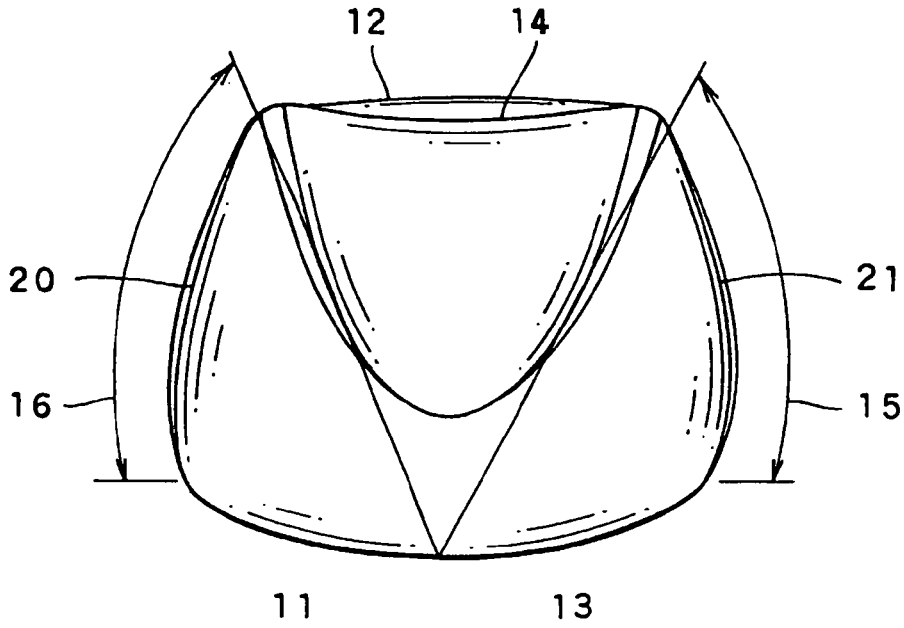
FIG. 5 is a bottom view illustrating the wood type club according to the embodiment.
Figure 6:
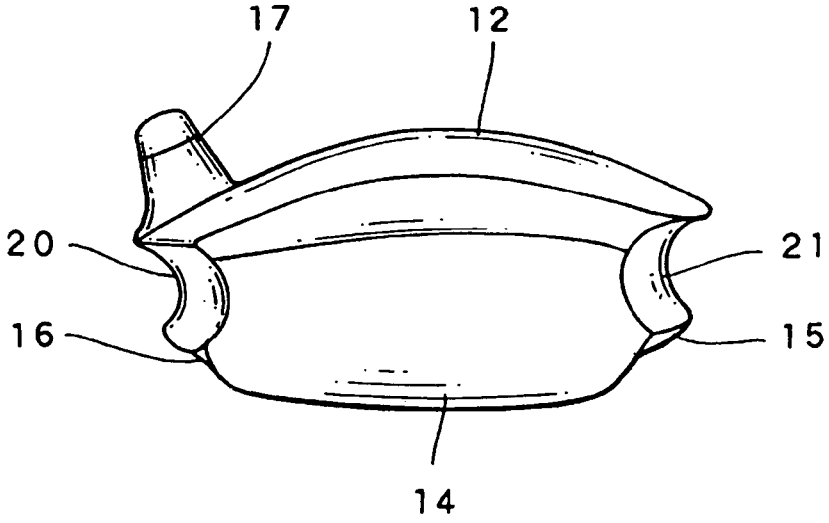
FIG. 6 is a rear view illustrating the wood type club according to the embodiment.
Figure 7:
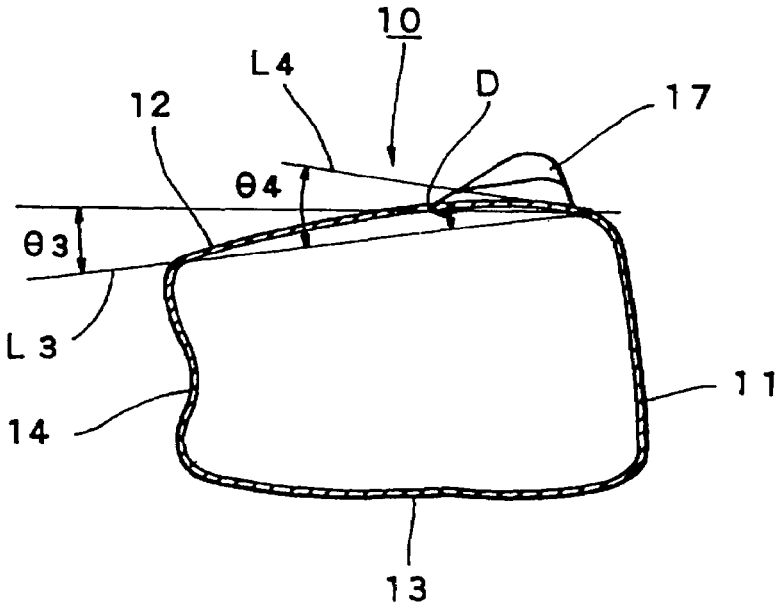
FIG. 7 is a central longitudinal sectional view illustrating the wood type club according to the embodiment.
Figure 8:
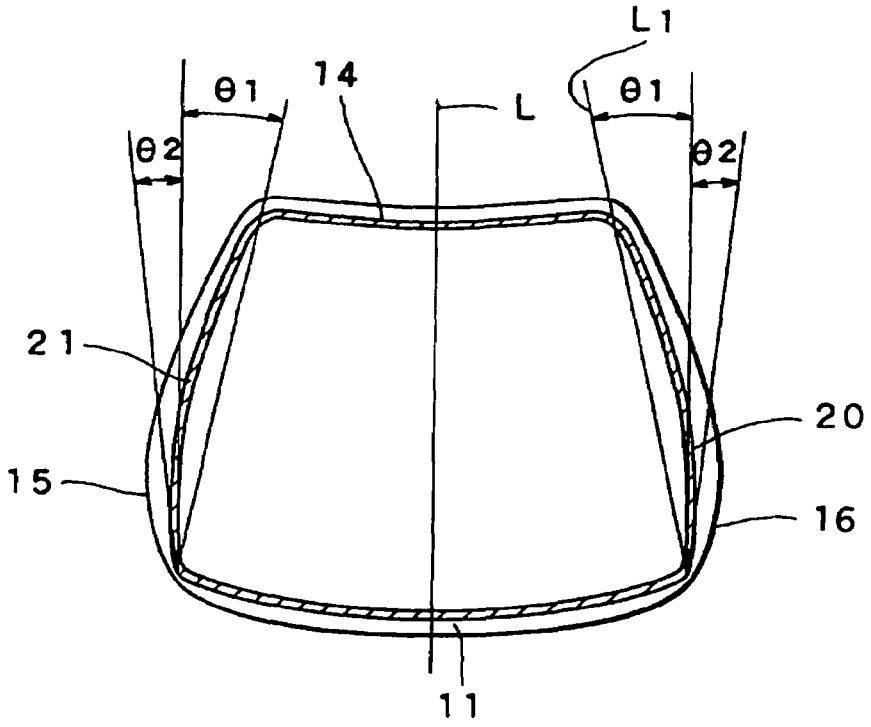
FIG. 8 is a cross sectional view illustrating the wood type club according to the embodiment.

10: HEAD
11: FACE PART
12: CROWN PART
13: SOLE PART
14: BACK PART
15: TOE-SIDE PART
16: HEEL-SIDE PART
17: HOSEL
20, 21: CONCAVE GROOVE

BEST MODE FOR CARRYING OUT THE INVENTION

Hereinafter, a specific example of the invention will be described in detail. FIGS. 1 to 8 illustrate a wood type club according to an embodiment of the invention. In the drawings, a club head 10 is a hollow casting product (or a forged product) in which a hosel 17 having a triangular pyramid shape is integrally formed with a heel-side part. A shaft 30 is connected to the hosel 17. The club head 10 includes a face part 11, a crown part 12, a sole part 13, a back part 14, a toe-side part 15, and a heel-side part 16. The face part 11 has a sweet spot S formed into a substantially spherical shape.

Upon taking a normal address posture with the club head 10, the crown part 12 has a substantially square shape in a head projection plane such that both outlines are formed in a circular-arc shape and a rear-end outline is formed in a linear shape. Additionally, the rear-end outline of the crown part 12 protrudes backward from the back part 14 in a roof shape.

The back part 14 is formed into an inclined surface having a circular-arc concave shape (or an oval concave shape) in which the back part 14 is inclined toward the face part 11 while being closer to the crown part 12 and the center portion of the back part 14 is lower than both side portions thereof in a toe-heel direction when viewed from the face part 11. The upper end portion of the back part 14 is continuously formed with the rear-end outline of the crown part 12.

In the toe-side part 15 and the heel-side part 16 located between the crown part 12 and the sole part 13 of the club head 10, concave grooves 20 and 21 are opened in a horizontal direction and extend from the face part 11 toward the back part 14 in a circular-arc shape to thereby form an engrave shape.

In the concave grooves 20 and 21, a curved part bulges outwardly and is located throughout the concave grooves 20 and 21 so that an angle θ2 in which a concave groove bottom extending from an inlet of the concave grooves to the inside thereof is inclined inward with respect to a line L perpendicular to the face part 11 is smaller than an angle θ1 in which a line L1 connecting an inlet of the concave groove bottom to an outlet thereof is inclined inward with respect to the line L perpendicular to the face part 11.

Upon taking the normal address posture with the club head 10, a vertical dimension h of an outer opening of each of the concave grooves 20 and 21 is set to 20 mm and a depth d of each of the concave grooves 20 and 21 is set to 10 mm in a case where a maximum height H of the crown part 12 is 60 mm.

Although a golf rule has a regulation of a toe front end and a heel front end, ranges of the toe part 15 and the heel part 16 are not particularly regulated. Therefore, since the rear-end outline of the crown part 12 is formed in a linear shape in the present example, for the convenience of the description, the gap between the outer end of the face part 11 and the linear rear-end outline of the crown part 12 are defined as the toe part 15 and the heel part 16.

Upon taking the normal address posture with the club head 10, the crown part 12 is formed in a circular-arc shape in which a line L3, extending backward while forming an angle θ3 in a range of −15° to +15° with respect to a horizontal plane and passing through a position of the upper-end outline of the face part 11 of the head 10 in a reference vertical plane passing through the center of gravity of a head and the center of gravity of a face of the face part 11 of the head 10, intersects a position between a rearmost point of the crown part 12 and 25% of a longitudinal distance from the rearmost point to the face part 11 (in the present example, the linear rear-end outline of the crown part 12) and a maximum vertical distance D between the crown part 12 and the line L3 is 10 mm or less (in the present example, 8 mm).

An outer surface facing backward from the crown part 12 has a portion forming an angle θ4 with respect to the line L3 of the outer surface in the reference vertical plane, the angle θ4 being larger than the angle θ3 formed between the line L3 and the horizontal plane.

Then, the circular-arc shape of the crown part 12 is in the shape of a band having a predetermined width in a toe-heel direction (in the present example, the circular-arc shape is a shape of a curve surface continuously formed in a toe-heel direction so as to correspond to the shape of the upper-end outline of the face part 11).

Figure 11:
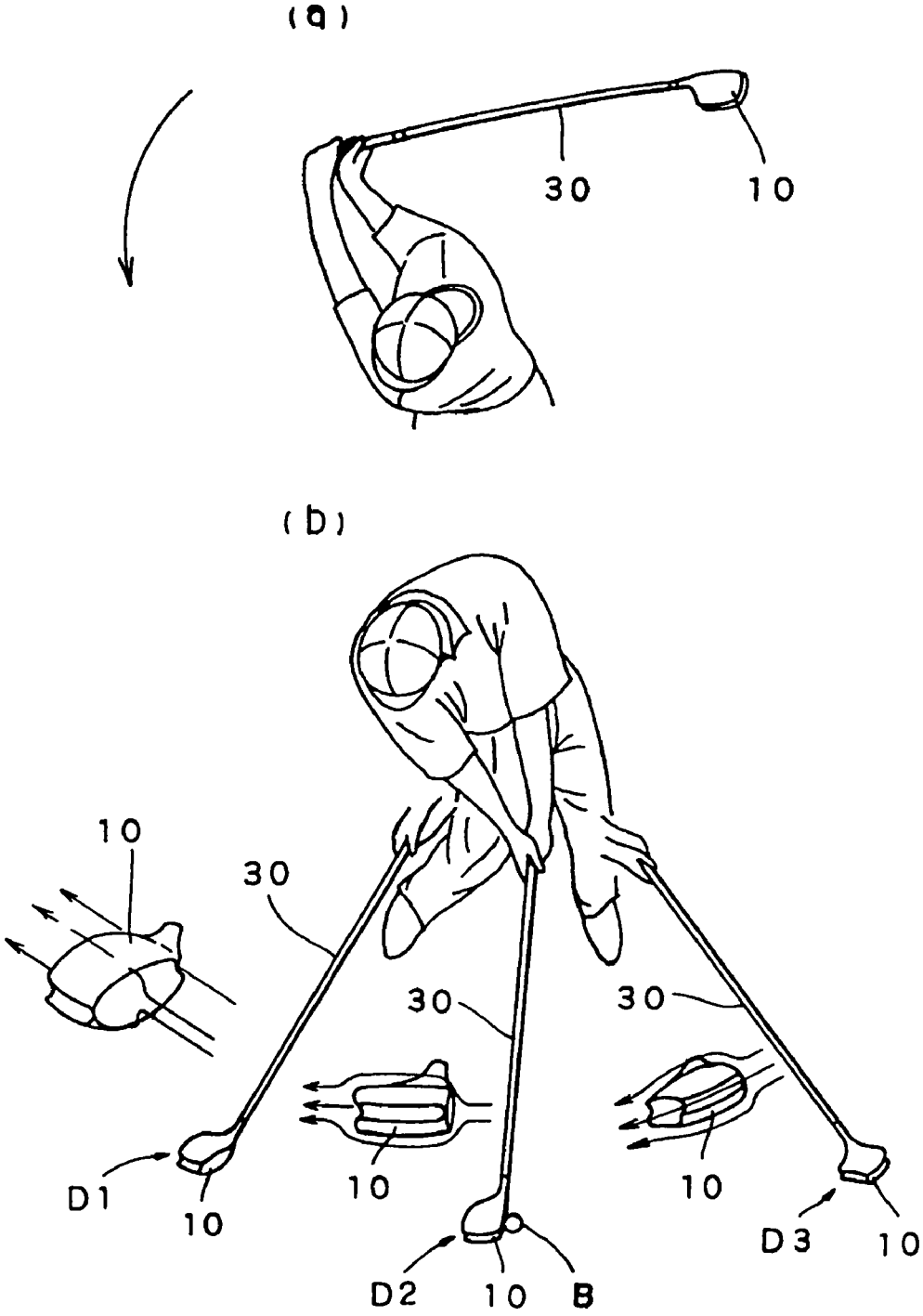
FIGS. 11A and 11B are views schematically illustrating a movement of a club head according to the embodiment during a swing action.

When a backswing of the club shown in the present example is carried out and a downswing thereof is started from a top position shown in FIG. 11A, as depicted by the arrow D1 of FIG. 11B, an air stream flows along the outer surfaces of the sole part 13 and the crown part 12 of the club head 10, and then a high-speed air stream flows into the concave groove 20 of the heel-side part 16. The high-speed air stream at the heel-side part 16 serves as a force for allowing the club head 10 to take a square posture.

Figure 9:
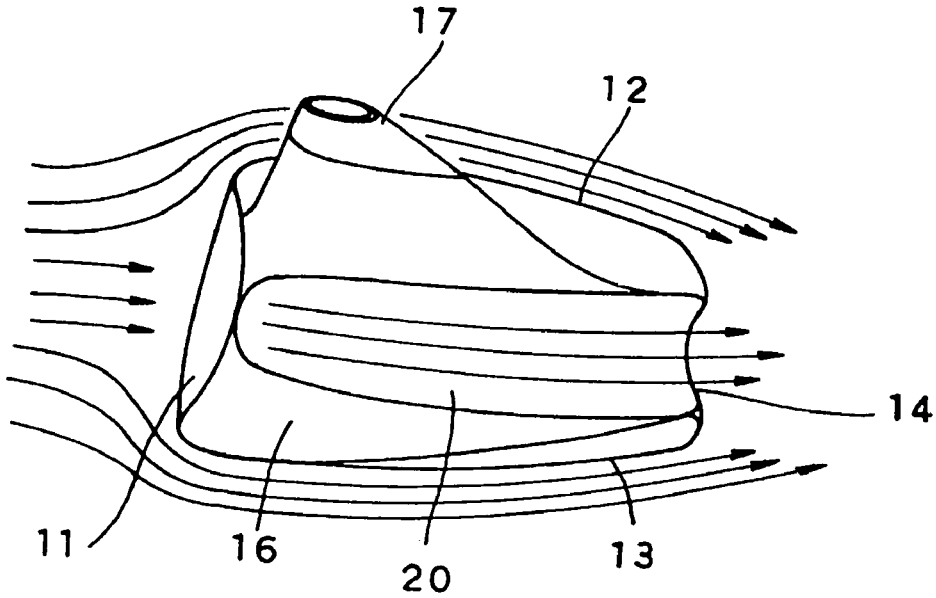
FIG. 9 is a view schematically illustrating a high-speed air stream in a crown part and a sole part according to the embodiment.
Figure 10:
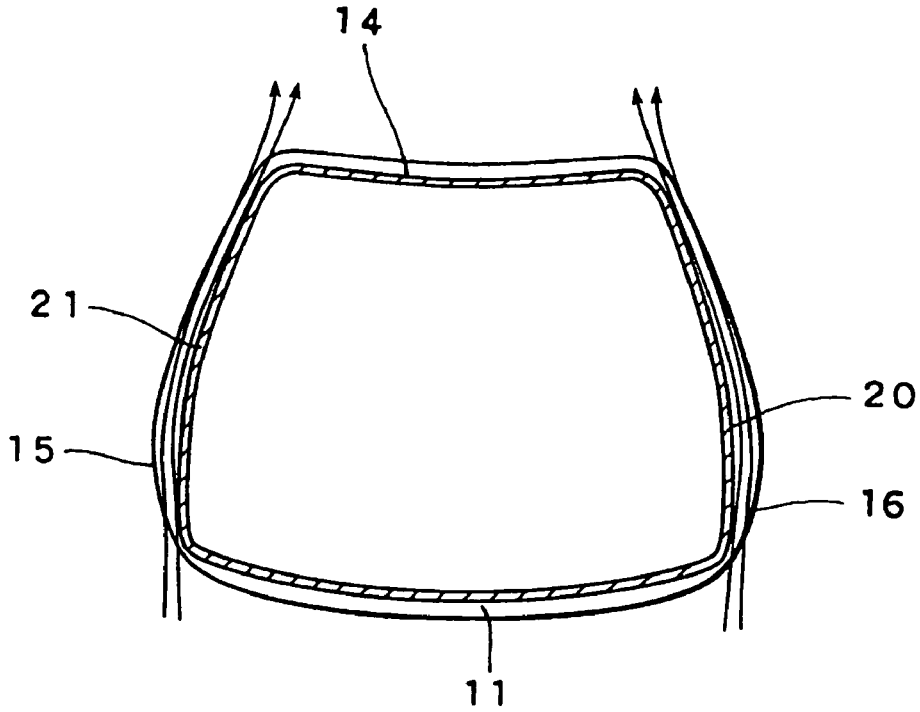
FIG. 10 is a view schematically illustrating a high-speed air stream in a concave groove according to the embodiment.

At this time, since the crown part 12 and the sole part 13 of the club head 10 are formed into a flat curved surface, as shown in FIG. 9, the air stream smoothly flows along the outer surfaces of the crown part 12 and the sole part 13 without producing a vortex flow.

When the club head 10 takes the square posture just before impact as depicted by the arrow D2 of FIG. 11B from the open state depicted by the arrow D1 of FIG. 11B, a high-speed air stream flows into the concave groove 21 of the toe-side part 15.

Subsequently, the club head 10 is guided by the two high-speed air streams at the toe-side part 15 and the heel-side part 16, and the club head 10 is maintained in the square posture against a golf ball B. Since the high-speed air stream at the toe-side part 15 flows into the concave groove 21 of the toe-side part 15 of the club head 10, a toe-down phenomenon of the club head 10 is restricted, thereby reducing and restricting the toe-down phenomenon.

Even when the club head 10 is opened or covered due to a certain reason, since the two high-speed air streams collide with the inner surfaces of the concave grooves 20 and 21 to thereby serve as a force for returning the club head 10 to be in the square posture, the club head 10 is corrected to be in the square posture.

A follow-through action is carried out after the impact. At this time, since the toe-side part 15 advances more than the heel-side part 16 as depicted by the arrow D3 of FIG. 11B during the follow-through action, a high-speed air stream flows into the concave groove 21 of the toe-side part 15 to thereby guide the club head 10, thereby lightly carrying out the follow-through action of the club head 10.

In the club head 10 in the present example, since the concave grooves 20 and 21 are formed in a shape in which a high-speed air stream is produced, it is possible to reliably maintain and correct the posture.

As described above, the swing posture of the club head 10 is maintained and corrected by the high-speed air streams flowing into the concave grooves 20 and 21 of the toe-side part 15 and the heel-side part 16. However, when the concave grooves 20 and 21 are formed in a linear shape, a vortex flow is produced in the high-speed air streams to thereby cause a swing resistance.

On the contrary, in the present example, since the concave grooves 20 and 21 are formed in a circular-arc shape in which the outside bulges, the high-speed air streams flowing into the concave grooves 20 and 21 smoothly flow along the concave groove bottom without producing a vortex flow, thereby improving a head speed.

As a result, it is possible to lightly swing the club head 10 and to improve the head speed. Accordingly, it is possible to efficiently transmit the momentum to the golf ball B.

As described above, since the club head 10 in the present example is in the square posture at the moment of impact, and the momentum of the downswing is directly transmitted to the golf ball B, it is possible to accurately and stably swing the golf ball in a desired direction with a long flying distance.

Figure 12:
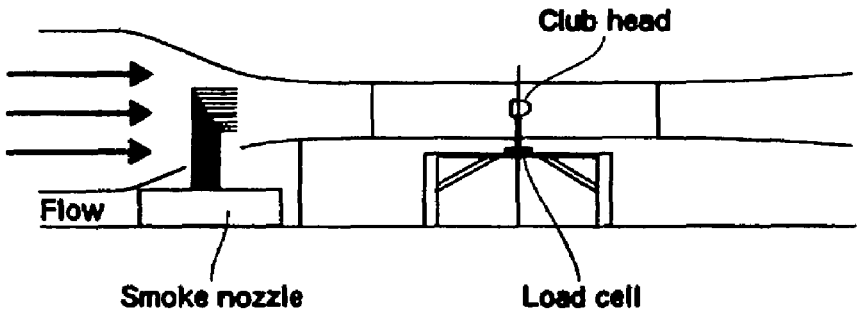
FIG. 12 is a view illustrating a configuration of a device configured to measure a performance of the wood type club according to the embodiment.

The present inventors have measured a drag characteristic of the club head 10. As shown in FIG. 12, the measurement is carried out such that the golf club is set at a three-component strain gauge. A measurement condition is set such that a flow speed is 18 m/s and the number of Re is 142,000. A relationship between a drag coefficient and a flow in the vicinity of the club head is investigated by the use of a visualizing method (injection tracer method).

Figure 13:
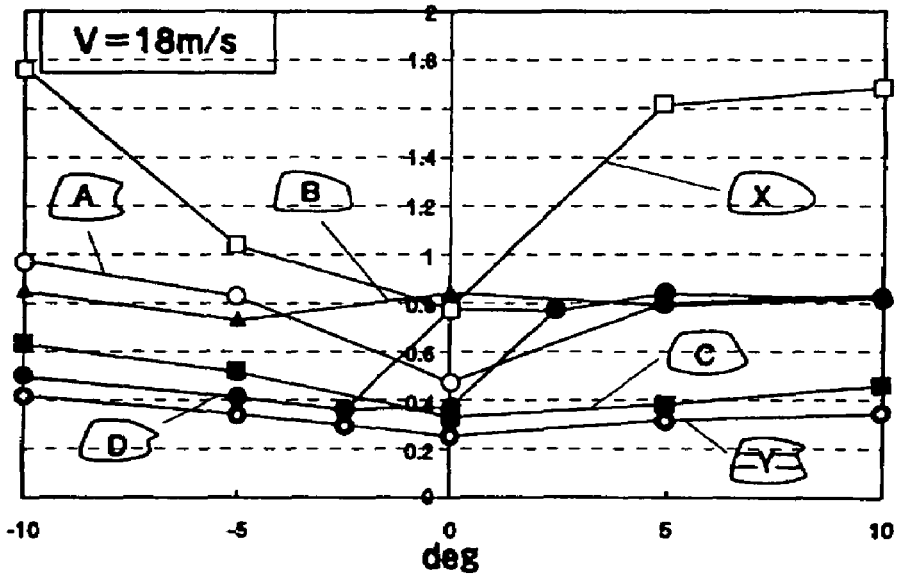
FIG. 13 is a view illustrating a relationship between a drag coefficient and a shape of the club head.

FIG. 13 shows an investigation result between the drag coefficient and the shape of the club head. In the drawing, A to D, X, and Y denote the shapes of the club heads. "Y" denotes the club head shown in the present example, and "D" denotes the club head which is formed in the same shape as the club head 10, but does not have the concave grooves 20 and 21. The drag coefficient of the club head 10 shown in the present example has the minimum value of 0.3 or less at the moment of impact. Accordingly, it is understood that the club head 10 has excellent performance.

The invention claim is:

1. A wood type club comprising:

a hollow head provided with a face part, a crown part, a sole part, and a back part and in which a hosel is formed on a heel side of the crown part so as to be connected to a shaft, wherein a toe-side part and a heel-side part located between the crown part and the sole part of the head are respectively provided with at least one concave groove opened outward in a horizontal direction and extending from the face part to the back part in a longitudinal direction so as to guide an air stream to the head in case of a swing action, wherein a whole part or a part of the concave groove is provided with a curved part bulging outwardly so that an angle in which a concave groove bottom formed from an inlet of the concave groove to an inside thereof is inclined inward with respect to a line perpendicular to the face part is smaller than an angle in which a line connecting an inlet of the concave groove bottom and an outlet thereof is inclined inward with respect to the line perpendicular to the face part, wherein the crown part is formed in a circular-arc shape in which a line, extending backward while forming an angle in a range of −15° to +15° with respect to a horizontal plane and passing through a position of an upper-end outline of the face part of the head in a reference vertical plane passing through the center of gravity of a head and the center of gravity of a face of the face part of the head upon taking a normal address posture with the head, intersects a position between a rearmost point of the crown part and 25% of a longitudinal distance from the rearmost point to the face part and a maximum vertical distance between the crown part and the line is 10 mm or less, and wherein the circular-arc shape of the crown part is a shape of a curve surface continuously formed in a toe-heel direction so as to have a band shape having a predetermined width when viewed from the reference vertical plane.

2. The wood type club according to claim 1, wherein an outer surface facing backward from the crown part has a portion forming an angle with respect to the line of the outer surface in the reference vertical plane, the angle being larger than the angle formed between the line and the horizontal plane.

3. The wood type club according to claim 1, wherein the circular-arc shape of the crown part is in the shape of a curved surface extending continuously in a toe-heel direction so as to correspond to a shape of the upper-end outline of the face part.

4. The wood type club according to claim 1, wherein the crown part is formed in the circular-arc shape in which the line extends backward while forming an angle in a range of −10° to +10° with respect to the horizontal plane and the maximum vertical distance between the crown part and the line is 8 mm or less.

* * * * *